United States Patent [19]

Jimenez et al.

[11] Patent Number: 5,063,866

[45] Date of Patent: Nov. 12, 1991

[54] SEWING MACHINE

[75] Inventors: Antonio Jimenez, Meyrin; Michel Combepine, Les Avanchets, both of Switzerland

[73] Assignee: Mefina S.A., Switzerland

[21] Appl. No.: 443,673

[22] Filed: Nov. 30, 1989

[51] Int. Cl.[5] ..... B65H 57/00; D05B 49/00; D05B 75/00

[52] U.S. Cl. ..... 112/302; 112/241; 112/259; 112/279

[58] Field of Search ..... 112/241, 250, 259, 279, 112/302

[56] References Cited

U.S. PATENT DOCUMENTS

| | | | |
|---|---|---|---|
| 3,645,220 | 2/1972 | Casas-Robert | 112/279 |
| 3,749,039 | 7/1973 | Fritts | 112/302 |
| 4,070,977 | 1/1978 | Yamamoto et al. | 112/259 |
| 4,296,701 | 10/1981 | Larsen | 112/302 |
| 4,466,371 | 8/1984 | Larsen | 112/302 |
| 4,660,482 | 4/1987 | Skogward | 112/241 |
| 4,776,292 | 10/1988 | Rodda et al. | 112/241 |
| 4,907,517 | 3/1999 | Hanyu et al. | 112/241 |

FOREIGN PATENT DOCUMENTS

| | | |
|---|---|---|
| 0251633 | 1/1988 | European Pat. Off. . |
| 0204426 | 2/1990 | European Pat. Off. . |
| 1809863 | 9/1977 | Fed. Rep. of Germany . |
| 61-151681 | 9/1986 | Japan . |
| 61-206480 | 9/1986 | Japan . |
| 677119 | 4/1991 | Switzerland . |

*Primary Examiner*—Werner H. Schroeder
*Assistant Examiner*—Paul C. Lewis
*Attorney, Agent, or Firm*—Cushman, Darby & Cushman

[57] ABSTRACT

In a sewing machine, a thread-draw lever is driven in an oscillating movement, in synchronism with a needle bar, and carries a gripping hook for the thread, the thread being brought within reach of this hook by passing it into a longitudinal channel formed on an upper face of an upper arm of the casing of the machine.

The arrangement permits the threading operation in a sewing machine to take place by simple insertion of the thread into the channel, without having to pass the thread through eyelets.

4 Claims, 4 Drawing Sheets

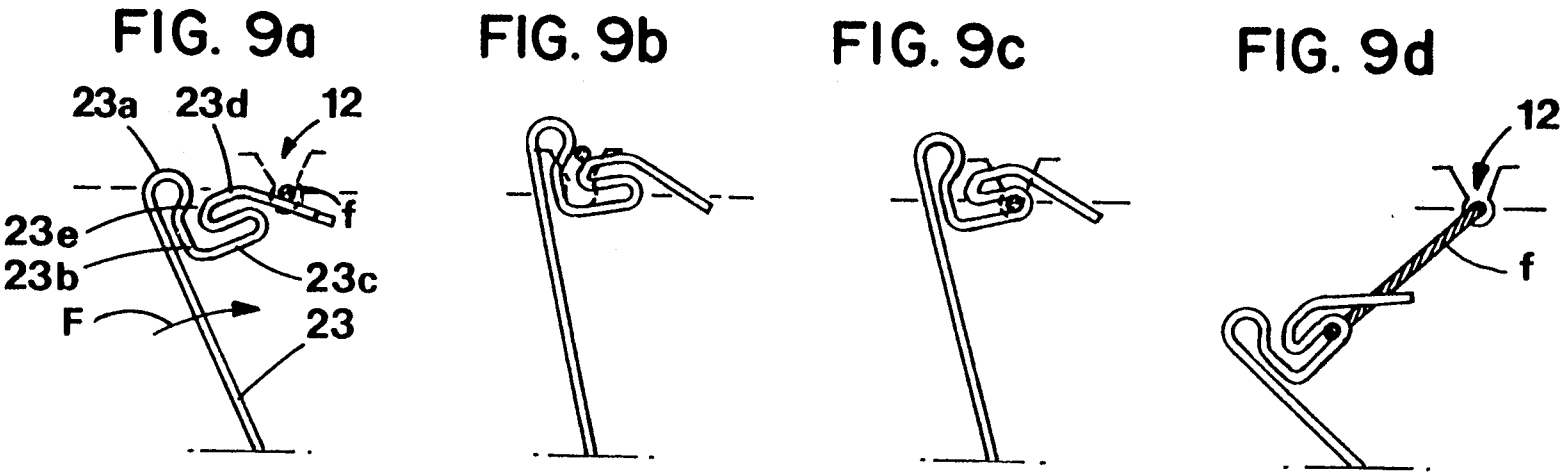
FIG. 9a
FIG. 9b
FIG. 9c
FIG. 9d
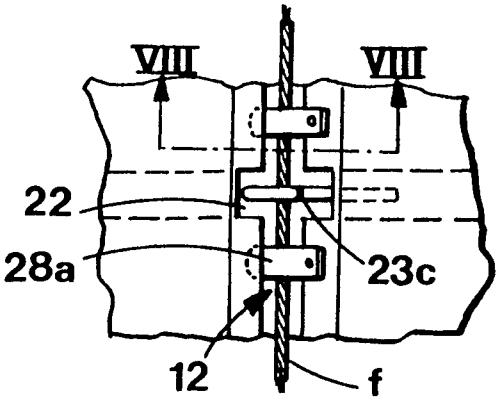
FIG. 7
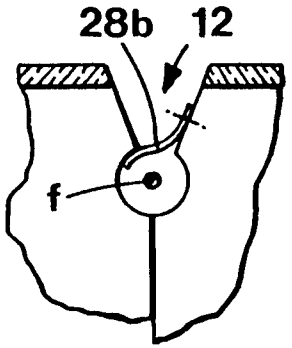
FIG. 8

SEWING MACHINE

BACKGROUND OF THE INVENTION

1. Field of the Invention

The present invention relates to a sewing machine comprising a casing having a lower arm, an upper arm, a column connecting these arms, and in the upper arm of which a needle bar is slidingly mounted and a thread-draw lever is mounted for rocking displacement, means for driving this needle bar and this thread-draw lever in synchronised respective alternating movements and means for guiding the thread between a feed spool and a needle carried by the needle bar, defining a path for this thread which corresponds to a portion of the path of the thread-draw lever for enabling the drive of the said thread at least in one direction of displacement of the thread-draw lever.

2. Description of the Prior Art

There has already been proposed in JP-U-61-151681 a threading system in which the thread-draw arrangement comprises a gripping opening for the thread and an incline adjacent to an entry channel to this gripping opening. This thread-draw arrangement is driven in a rocking movement in synchronism with the alternating sliding movement of the needle bar. A passage containing the path of the thread-draw arrangement is formed in the upper arm of the casing of the machine to enable exit from the casing at the gripping opening for the thread. Guide means for the thread serve to maintain a portion of this thread across the exit passage from the thread guide in the path of the incline adjacent to the entry channel in such a manner that when the thread-draw arrangement is displaced towards the thread, the incline meets the thread and makes it slide on the incline by displacing it from its path until it penetrates into the gripping opening through the entry channel. An extension disposed opposite the entry channel of the gripping opening prevents untimely exit of the thread. This thread-draw arrangement thus enables automatic introduction of the thread by the simple fact that it is guided across the exit passage of the thread guide and as a result extends transversely to its path.

If the introduction of the thread into the gripping opening of the thread guide is automatic, it is not the same for the thread guidance means directing the thread from the feed spool to the needle of the needle bar. In effect, several thread guides are disposed along the path of the thread and in particular at the narrow point where the thread changes direction to descend towards the needle. After having been guided into a horizontal guide groove along which there is disposed a thread grip, the thread leaves the groove and must be introduced into a retaining guide before being directed into a vertical groove comprising guide members into which this thread must be introduced. As a result, the threading of the thread, except in regard to the thread-draw arrangement, remains quite traditional and thus demands meticulous work necessitating in particular good eyesight on the part of the operator. Moreover, this threading also forms a source of frequent errors.

There has also been proposed a simplified threading system in U.S. Pat. No. 3,347,195, in which the feed spool for the thread is disposed against the rear face of the machine and the upper face of the casing of the machine is traversed by a transverse groove permitting guidance of the thread towards the front face, the thread grip being located along this transverse groove.

The remainder of the threading is traditional, the thread having in particular to be introduced into an opening of the thread-draw lever.

It has also been proposed to try to drive the thread by a thread-draw arrangement without the thread-draw arrangement gripping the thread. By this manner of thread drive, a simple lever is sufficient, and it is no longer necessary to introduce the thread into the opening of the thread guide lever. Mechanisms of this kind are described in DE-A-1,809,863 as well as in EP-A1-0,251,633. As in the case of the other solutions mentioned above, the thread must still be passed into the thread guides on account of sharp changes of direction in the path of the thread.

BRIEF SUMMARY OF THE INVENTION

An object of the present invention is to advantageously simplify further this operation of threading. To this end, this invention has as its subject a sewing machine comprising a casing having a lower arm, an upper arm, and a column connecting these arms, a needle bar being slidingly mounted in the upper arm and a thread-draw lever being mounted in the upper arm for rocking displacement; means for driving the needle bar and the thread-draw lever in synchronised respective alternating movements; and means for guiding the thread between a feed spool and a needle carried by the needle bar, said guiding means defining a path for the thread which is a portion of the path of the thread-draw lever for permitting drive of said thread in at least one direction of displacement of the thread-draw lever, wherein said guiding means is formed by a continuous channel extending on at least a part of the upper face and a part of the side face of the upper arm adjacent to the needle bar, on both sides of an aperture opening into said channel.

BRIEF DESCRIPTION OF THE DRAWINGS

The accompanying drawings illustrate, by way of example, an embodiment of the present invention.

FIG. 7 is a view to a larger scale of a detail of the left-hand portion of FIG. 2.

FIG. 8 is a section on the line VIII—VIII of FIG. 7.

FIGS. 9*a* to 9*d* illustrate the thread-draw arrangement in four positions of operation (capture and drawing of the thread).

DETAILED DESCRIPTION OF THE DRAWINGS

Figure 1:
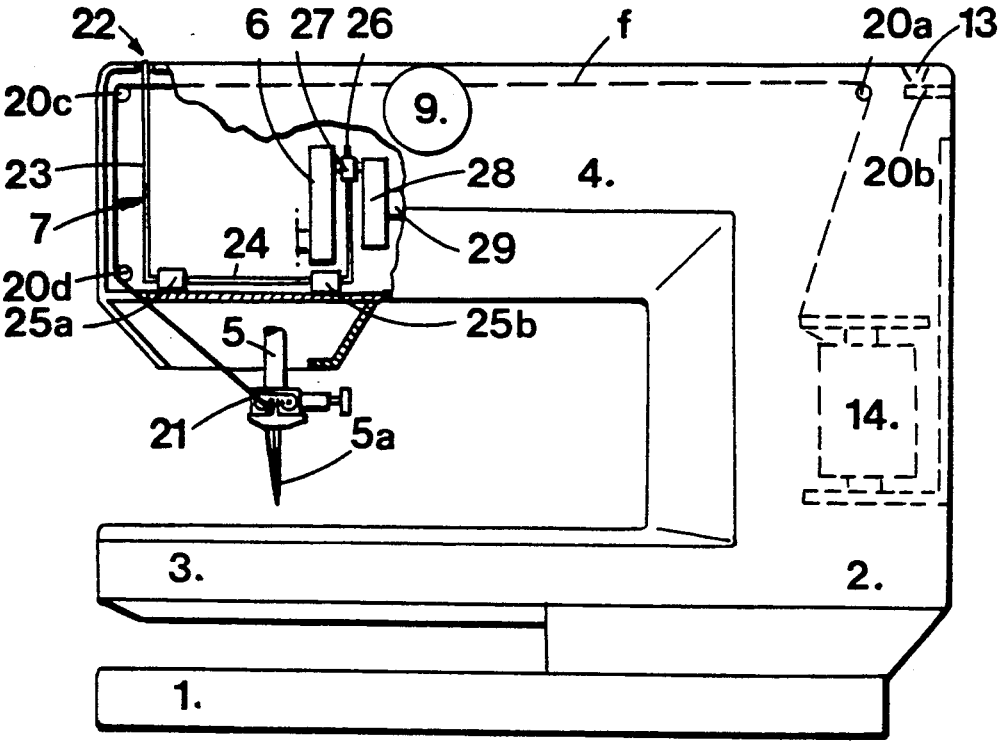
FIG. 1 shows a sewing machine according to the invention in elevation.

The sewing machine shown in the drawings (FIGS. 1 to 4) has a base plate 1 on the right-hand part of which stands a column 2 carrying two arms 3 and 4, of which that occupying the lower position, 3, contains in particular a loop pick-up device and its control mechanism, neither of which are shown. The upper arm 4 carries a needle bar 5 and its driving mechanism 6, partially shown, a thread take-up assembly 7, the structural details of which will be described in detail below, a device 8 for adjusting the tension of the thread f and its control knob 9 (FIG. 2), a wheel 10, and a bobbin winder 11 associated with this wheel (FIG. 3).

The structure and the manner of operation of a device such as that indicated by the reference 8, which enables adjustment of the thread tension, are described for example in allowed U.S. application No. 07/408,032, which may be referred to for more details.

In a similar manner, Swiss Patent No. 677,119, application No. 4,024,188 by the assignee may be referred to for information as to the manner of driving the wheel 10 and the bobbin winder 11.

The upper and left-hand side faces (FIGS. 2 and 4) of the casing of the machine are provided with a rectilinear channel 12, extending in the longitudinal direction of the casing, approximately in the median plane of the arm 4.

As is to be seen clearly in FIG. 8, this channel has a substantially V-shaped cross-section, the bottom of which is partially circular. Moreover, it will be noted that the device 8 for adjusting thread tension is partially disposed in the interior of this channel 12, more particularly the active portion of the thread gripping plates which it comprises.

Figure 2:
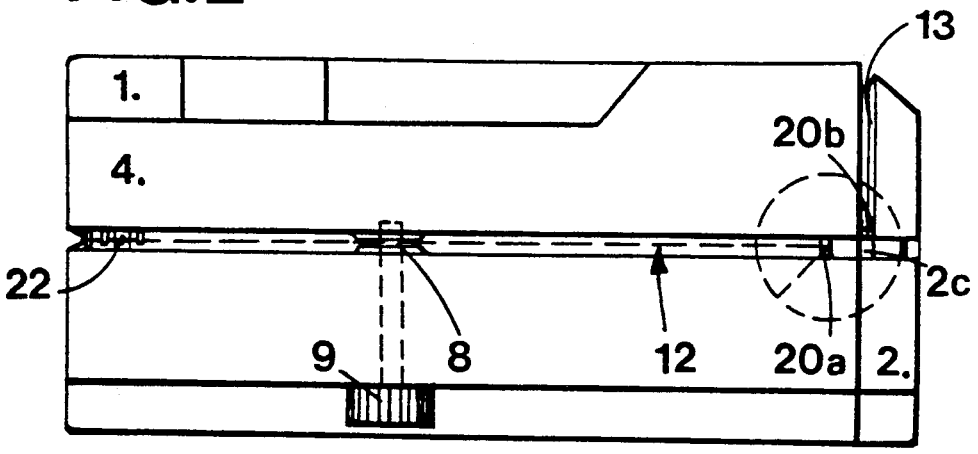
FIG. 2 is a plan view of the sewing machine of FIG. 1.
Figure 3:
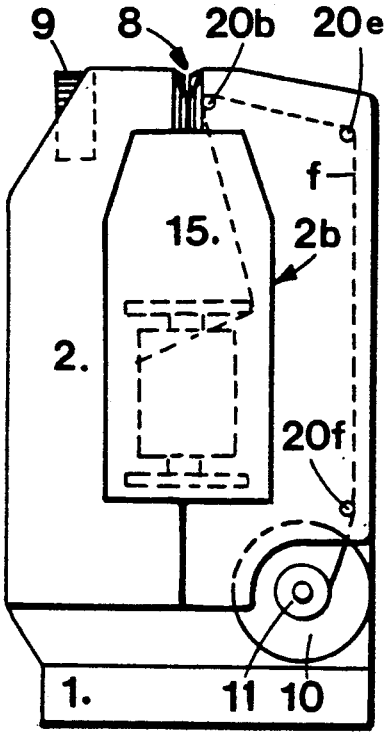
FIG. 3 is a right-hand side view of the sewing machine of FIG. 1.
Figure 4:
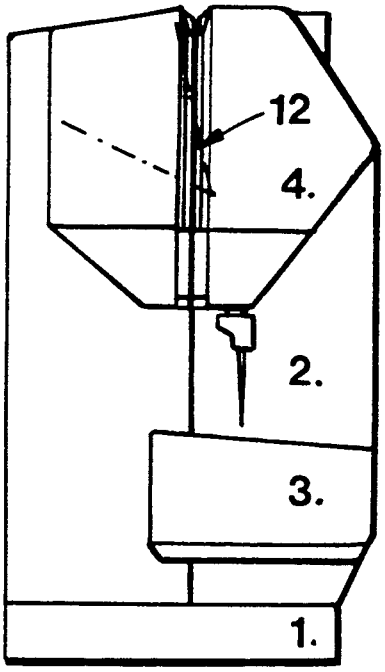
FIG. 4 is a left-hand side view of the sewing machine of FIG. 1.

The casing of the machine shown also has a second channel 13 extending in a transverse plane and connecting with the channel 12 at the right- hand extremity of this channel (FIG. 2). The channel 13 is formed not only on a part of the upper surface of the column 2 of the casing, but also on the rear surface of the casing, where the channel 13 extends as far as the region of the wheel 10 and the aforementioned bobbin winder 11. The cross-section of the channel 13 is of a similar shape to that of the channel 12.

The channels 12 and 13 in effect permit, respectively, the passage of the thread taken up from a feed bobbin 14 towards the needle 5*a* fixed at the end of the needle bar 5, or its passage towards the spool winder 11, depending on whether it is desired to use the machine shown for sewing, or, alternatively, for winding a spool 11.

Figure 5:
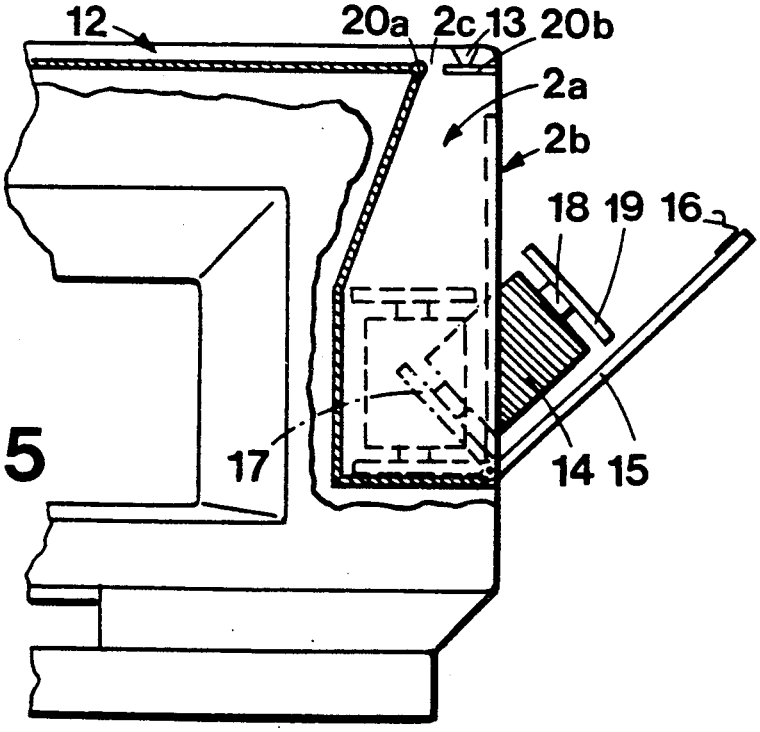
FIG. 5 is a partial view corresponding to that of FIG. 1 in another position of certain members.

Accordingly, the column 2 comprises a recess 2*a*, accessible through an opening 2*b* (FIGS. 3 and 5) along the lower edge of which there is pivotally mounted a cover 15 capable of being manually moved into two end positions. One of these is a tilted position, as shown in solid line in FIG. 5, which allows access to the recess 2*a* in the column 2. The other position is a rest position in which the cover 15 closes off the opening 2*b*. Maintenance of the cover 15 in the position in which it closes off the recess 2*a* is assured by means of a catch 16 fixed along the upper edge of the cover 15, which cooperates with a lug, (not shown), fixed near the upper edge of the opening 2*b*.

A base portion 17 of the cover 15 forms a body for a spool support 18 standing parallel to the cover 15. A detachable disc 19 fixed to the upper end of the support 18 enables a regular supply of thread from the spool 14 to be assured during sewing or winding of a bobbin. While the machine is operating, the cover 15 is in a vertical position, closing off the recess 2*a* in the column 2; it is only brought to its tilted position (FIG. 5) when it is a question of replacing the spool 14, for example.

In its upper part, the wall of the recess 2*a* has an opening 2*c*, which places this recess in communication with the bottom of the channels 12 and 13, respectively, and on the edges of which are fixed two thread guides 20*a* and 20*b*, respectively.

Other similar thread guides 20*c* and 20*d* (FIG. 1), and 20*e* and 20*f* (FIG. 3), respectively, enable correct guidance of the thread f, taken up from the spool 14, to be assured in the interior of the channel 12 or that of the channel 13, respectively, as far as a needle collar 21, in the first case, and to any bobbin placed on the bobbin winder 11, in the second case.

In regard to the passage of the thread f, in the channel 12, this thread must, in fact, first of all be brought between the gripping plates of the tensioning device 8 at a level enabling the best possible functioning of the plates of this device to be assured. It must also present itself at right angles to an aperture 22 formed at the left-hand end, in the drawings (FIGS. 1, 2 and 7), of the channel 12 in such a way that it may be caught hold of, in passing, by the thread take-up assembly 7.

The thread take-up assembly 7 comprises a thread-draw lever 23 which forms the left-hand limb (FIG. 1) of a rod bent into a U-shape. The rod has an intermediate portion 24 pivoted in two bearings 25*a* and 25*b* fixed to the frame of the machine. The limb 26 at the right-hand end of this rod is slideably engaged in a corresponding opening provided by a socket 27 pivoted at the end of an arm 28 keyed on a shaft 29. This shaft 29 is that which controls the alternate axial movement of the needle bar 5, a movement obtained by the mechanism 6.

The two limbs 23 and 26 of the thread take-up assembly are not co-planar. The limb 23, viewed from the front face of the machine, occupies a set-back position with respect to the limb 26 such that when it occupies its most forward tilted position, the limb 23 is located as shown in solid line in FIG. 6. The axis 23* corresponds to the maximum backward position into which the limb 23 may be brought; in this case, at the same time, the limb 26 will occupy an angular position substantially corresponding to the maximum forward position of the limb 23 (in solid line in the drawing).

At its free end, the thread take-up means formed by the limb 23 is bent in such a way as to form a sort of eyelet 23*a* followed by a rectilinear part 23*b*, which itself is in turn followed by a bent portion 23*c*, forming a "hook", at the end of which follows a portion 23*d* forming an "incline". This comprises three sections, the first of which, starting from the edge of the opening of the hook 23*c*, is substantially parallel to the end part of the eyelet 23*a* and defines with this eyelet a channel 23*e*. The second section extends parallel to the upper limb of the hook and the third section extends away from this hook to a level below that of the limb of the hook integral with the part 23*b* of the hook.

It should be noted that the length of the space encompassed by the limbs of the hook is several times greater than the greatest diameter of thread capable of being used by the sewing machine described. It may for example be from five to seven times this diameter. In addition, the length of the hook, the distance separating the open end of the hook and the part 23*b* mentioned above, as well as the width of the access channel delimited by this part and by the "incline" 23*d* are substantially equal and are also dependent upon the maximum diameter of the sewing thread.

Referring to FIGS. 7 and 8, it can be seen that on both sides of the aperture 22, the machine shown is provided with two leaf springs 28*a* and 28*b*, attached at one end to the right-hand edge, as shown in the drawings, of the channel 12, and the other end of which is inserted into the bottom of the circular section of this channel, in contact with it.

The leaf 28*a* and the leaf 28*b* are sufficiently flexible for their flexure to be obtained simply by applying the thread against their upper surfaces and exerting, with the fingers, a light vertical thrust on this thread.

Essentially, the springs serve to ensure that once the thread f is inserted in the channel 12, at least the portion of this thread situated, at each instant, to the right-hand side of the aperture 22 cannot escape from this channel.

In effect it is essential that this condition be fulfilled so that each time a thread is unwound from the spool 14 to be brought towards the needle collar 21 by passing it through the channel 12, across the tension device 8–9, at right angles to the aperture 22, then around the thread guides 20*c* and 20*d*, the thread-draw lever 23 is able to grasp, by itself, this thread in the manner described hereinafter with reference to FIGS. 9*a* to 9*c*, while making it enter into the interior of the hook 23*c*.

Figure 6:
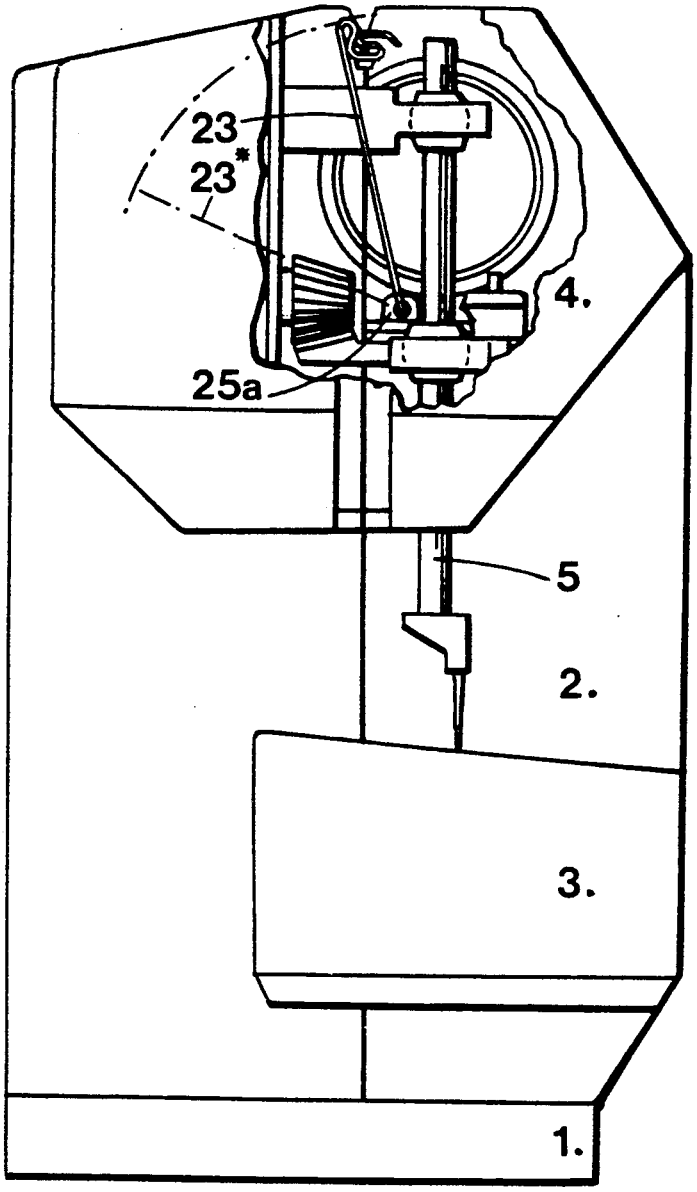
FIG. 6 is a view similar to that of FIG. 4 to a larger scale and with partial cutting-away of the machine casing.

In effect, and as is to be clearly seen in FIG. 6, the length of the thread-draw lever 23 and the dimensions of its parts 23*a* to 23*d* are chosen so that the distance separating the mean longitudinal axis of the body of the hook 23*c* and the axis of pivoting of the thread-draw lever are spaced one from the other by a value substantially corresponding to the mean distance separating the part of the channel 12 of circular cross-section and the same axis of pivoting mentioned above. Moreover, the path of the thread-draw lever 23 is chosen so that at the right-hand end of this path, in which it is shown in solid line, the hook of the thread-draw lever substantially occupies a central position with respect to the axis of linear travel of the thread f.

It is to be noted that the hook 23*c* of the thread-draw lever 23 may enter into the channel 12 to reach this central position because of presence of the aforementioned aperture 22.

The four FIGS. 9*a* to 9*d* show in detail how the thread-draw lever proceeds to grasp the thread f and causes it to pass into the opening of its hook.

When the thread-draw lever is tilted in direction F (FIG. 9*a*) from its extreme left-hand position towards its extreme right-hand position, the thread which has just been introduced into the channel 12 occupies a position substantially corresponding to that illustrated in FIGS. 7 and 8.

Before reaching the extreme right-hand position of the thread-draw lever, the incline 23*d* comes in contact with the thread f and pushes it upwards, in the drawing, by sliding on the incline itself as the lever continues to move in the direction F to go beyond the position occupied in FIG. 9*a*.

As the thread f is in a taut condition between the device 8 and the needle collar 21, the fact of its moving away from its equilibrium position causes this thread to be lifted by the incline 23*d* associated with the hook 23*c* of the thread-draw lever, the thread exerting on this a slight thrust directed towards the bottom of the channel 12. Thus, when at the end of its sliding movement on the incline 23*d*, the thread f comes to find itself opposite the channel 23*e* delimited by the incline and by the eyelet 23*a* (FIG. 9*b*), this thread naturally enters into this channel and, from there, into the opening of the hook 23*c*, in such a way as to come back to its initial rest position (FIG. 8). The thread-draw lever 23 then occupies a position corresponding to its extreme right-hand position (FIG. 6).

From the moment when this thread-draw lever begins to return towards its extreme left-hand position (FIG. 9*c*), the thread f is then positioned at the bottom of the hook of the thread-draw lever and this lever has only to continue its path in the opposite direction to F. The sewing machine is then ready for sewing (FIG. 9*d*).

Of course, an identical result may be obtained by replacing the thread-draw lever described by a rod comprising, at its end, a hook and an incline associated with the hook made in one piece with the rod, for example, by stamping from a plate.

Moreover, the assembly described enables a sewing machine to be provided in which it is no longer necessary to thread the thread through an eyelet of the thread-draw lever before passing it through the needle collar.

Therefore the actual threading of the thread discharged from a mother spool is limited, in the sewing machine described, to passing the thread into the channel 12 while introducing it between the gripping plates of the thread tensioning device 8 and under the resilient strips 28*a* and 28*b* in the manner already described, and then by bringing it around the thread guides 20*c* and 20*d* towards the needle collar 21, to be then threaded through the eye of the needle. This operation is at the same time simple, speedy and sure; it does not necessitate any particular threading through eyelets.

It will again be noted that in the machine described, the thread-draw lever always moves inside the casing of the machine, hence achieving a more certain and a more logical operation of this thread-draw lever.

The invention is not, of course, limited to that which has been shown or described:in particular, it is to be understood that the channel 12 need not necessarily be located on the upper face of the upper arm of the machine. It may, of course, be formed in the front or rear face of this arm, for example, or only extend along a part of the length of the arm.

Furthermore, when the casing of the machine described is formed by assembly of two or several shells, the channel or channels described may be obtained by juxtapositioning the adjoining edges of these shells, each of the edges being individually given the profile of half of the channel desired.

We claim:

1. A sewing machine, having a casing with a support for a sewing thread spool and comprising a base, a column placed on said base and carrying an arm projecting laterally and extending above said base, said arm having at least a needle bar provided with a sewing needle, a mechanism for driving said needle bar in an axial reciprocating motion, first means defining a path for thread taken from said spool to the sewing needle, a thread tension device including second means for pinching the thread at a first intermediate point of said path, a thread tightening means disposed in a receptacle of said arm and including a take-up rocking lever having a hooked portion, and third means controlling the rocking movement of said lever from a first end position to a second end position and vice versa, in synchronism with axial motion of said needle bar, said arm of the casing having a lower face from which said needle bar projects, an upper face opposed to the lower face, first and second lateral faces joining said upper and lower faces of the arm, respectively, and a frontal face located at a free end of the arm, edges of said frontal face being defined by said upper, lower and lateral faces of the arm, said first means including devices for guiding the thread between said spool and a first zone of said upper face of the arm corresponding to said first intermediate point of said path for thread, and a first channel receiving thread emerging from said thread guide devices and including a first and a second channel segment, said channel segments being contiguous and extending one within the extension of the other, said first channel segment extending on said upper face of said arm, between said first zone of said upper face and said frontal face of the arm, and said second channel segment extending on said frontal face of the arm, from a first edge of said frontal face adjacent to said upper face of said arm, to a second edge of said frontal face, adjacent to said lower face of said arm, said pinching means being disposed at least partly inside said first channel segment, on said first zone of said upper face of said arm, at least a portion of the wall of said receptacle and at least a portion of the wall of the first channel segment being common to said receptacle and said first channel, said first channel segment communicating with said receptacle via a connecting window cut in said first wall portion of said first channel segment, and said thread tightening means being disposed in said receptacle of said arm so that, upon rocking of said lever from said first end position to said second end position under control of said third means, at least said hooked portion of said lever periodically traverses said connecting window and penetrates to the first channel within reach of said thread segment to grasp the thread, and upon subsequent rocking of said lever from said second end position to said first end position, a part of said thread segment grasped by said hooked portion is carried up by said hooked portion of said lever into said receptacle through said connecting window.

2. The sewing machine of claim 1, wherein said thread guide devices includes:

a second channel extending on said upper face of said arm of said casing and having a first and a second end, said first and second ends being located on said first zone and on a second zone of said upper face of the arm, respectively, said second zone corresponding to a second intermediate point of said spool, said second channel communicating by said first end with said first channel segment of said first channel, and fourth means guiding the thread emerging from said spool into said second end of said second channel.

3. The sewing machine of claim 1, wherein said thread guide devices includes: a second channel extending on said upper face of said arm of said casing and having a first and a second end, said first and second ends being located on said first zone and on a second zone of said upper face of the arm, respectively, said second zone corresponding to a second intermediate point of said thread path, situated between said first intermediate point of said path and said spool, said second channel communicating by said first end with said first channel segment of said first channel, and fourth means guiding the thread emerging from said spool into said second end of said second channel, said first channel segment of said first channel and said second channel being formed by a single groove extending over said upper face of the arm, from one end thereof to the other.

4. The sewing machine of claim 1, wherein said thread guide devices includes:

a second channel extending on said upper face of said arm of said casing and having a first and a second end, said first and second ends being located on said first zone and on a second zone of said upper face of the arm, respectively, said second zone corresponding to a second intermediate point of said thread path, situated between said first intermediate point of said path and said spool, said second channel communicating by said first end with said first channel segment of said first channel, and fourth means guiding the thread emerging from said spool into said second end of said second channel, said first channel segment of said first channel and said second channel being rectilinear and formed by a single groove extending longitudinally over said upper face of the arm, from one end thereof to the other.

* * * * *

UNITED STATES PATENT AND TRADEMARK OFFICE

CERTIFICATE OF CORRECTION

PATENT NO. :5,063,866

DATED :November 12, 1991

INVENTOR(S) :JIMENEZ ET AL

It is certified that error appears in the above-identified patent and that said Letters Patent is hereby corrected as shown below:

In Column 8, between line 1 and line 2, the phrase --said thread path, situated between said first intermediate point of said path and-- should be inserted.

Signed and Sealed this

Twelfth Day of October, 1993

*Attest:*

Bruce Lehman

BRUCE LEHMAN

*Attesting Officer*

*Commissioner of Patents and Trademarks*